US010233715B2

(12) United States Patent
Zonoz et al.

(10) Patent No.: US 10,233,715 B2
(45) Date of Patent: Mar. 19, 2019

(54) PACKER ASSEMBLY WITH MULTI-MATERIAL INSERTS FOR BLOWOUT PREVENTER

(71) Applicant: Cameron International Corporation, Houston, TX (US)

(72) Inventors: Ray Zonoz, Sugar Land, TX (US); Xuming Chen, Katy, TX (US)

(73) Assignee: Cameron International Corporation, Houston, TX (US)

( * ) Notice: Subject to any disclaimer, the term of this patent is extended or adjusted under 35 U.S.C. 154(b) by 157 days.

(21) Appl. No.: 15/218,936

(22) Filed: Jul. 25, 2016

(65) Prior Publication Data

US 2018/0023361 A1 Jan. 25, 2018

(51) Int. Cl.
*E21B 33/06* (2006.01)

(52) U.S. Cl.
CPC ..... *E21B 33/062* (2013.01); *E21B 33/06* (2013.01)

(58) Field of Classification Search
CPC ..... E21B 33/06; E21B 33/061; E21B 33/062; E21B 33/063; E21B 33/08; E21B 33/085; E21B 2033/005
USPC ..... 251/1.1, 1.2, 1.3
See application file for complete search history.

(56) References Cited

U.S. PATENT DOCUMENTS 2,287,205 A * 6/1942 Stone ..... E21B 33/06 137/539.5
2,609,836 A * 9/1952 Knox ..... E21B 33/06 251/1.2
3,737,139 A * 6/1973 Watts ..... E21B 33/06 251/1.2
3,915,426 A * 10/1975 LeRouax ..... E21B 33/06 251/1.1
4,099,699 A * 7/1978 Allen ..... E21B 33/06 251/1.2
4,458,876 A * 7/1984 Schaeper ..... E21B 33/06 251/1.2
5,224,557 A * 7/1993 Yenulis ..... E21B 33/085 166/84.3
6,367,804 B1 4/2002 Watts
6,955,357 B2 10/2005 Griffin et al.
(Continued)

FOREIGN PATENT DOCUMENTS

WO 2011128690 A1 10/2011

OTHER PUBLICATIONS

Durometer Shore Hardness Scale. Smooth-On, Inc. [retrieved on Feb. 20, 2018]. Retrieved from the Internet: <URL: https://www.smooth-on.com/page/durometer-shore-hardness-scale/>.*
(Continued)

*Primary Examiner* — Robert K Arundale
*Assistant Examiner* — Jonathan J Waddy
(74) *Attorney, Agent, or Firm* — Helene Raybaud

(57) ABSTRACT

A blowout preventer ("BOP") for sealing against an object includes a housing comprising a bore extending through the housing with the object being extendable through the bore. The BOP further includes a packer assembly movably positioned within the housing and configured to form a seal within the housing. The packer assembly includes a body comprising an elastomeric material and an insert at least partially positioned within the body. The insert comprises a harder material section and a softer material section with respect to the harder material section and configured to deform against the object.

21 Claims, 7 Drawing Sheets

(56) References Cited

U.S. PATENT DOCUMENTS

| | | | | |
|---|---|---|---|---|
| 2004/0164494 | A1 | 8/2004 | Araujo | |
| 2008/0023917 | A1 | 1/2008 | Khandoker | |
| 2009/0321066 | A1 | 12/2009 | Scoggins et al. | |
| 2010/0294482 | A1 | 11/2010 | Araujo et al. | |
| 2012/0227987 | A1 | 9/2012 | Castriotta et al. | |
| 2014/0183381 | A1* | 7/2014 | Carbaugh | E21B 33/062 251/1.1 |

OTHER PUBLICATIONS

'Embed'. Dictionary.com [online]. [retrieved on Sep. 12, 2018]. Retrieved from the Internet: <URL: https://www.dictionary.com/browse/embedded>.*

PCT International Search Report & Written Opinion for PCT Application No. PCT/US2017/043582 dated Nov. 6, 2017; 11 Pages.

* cited by examiner

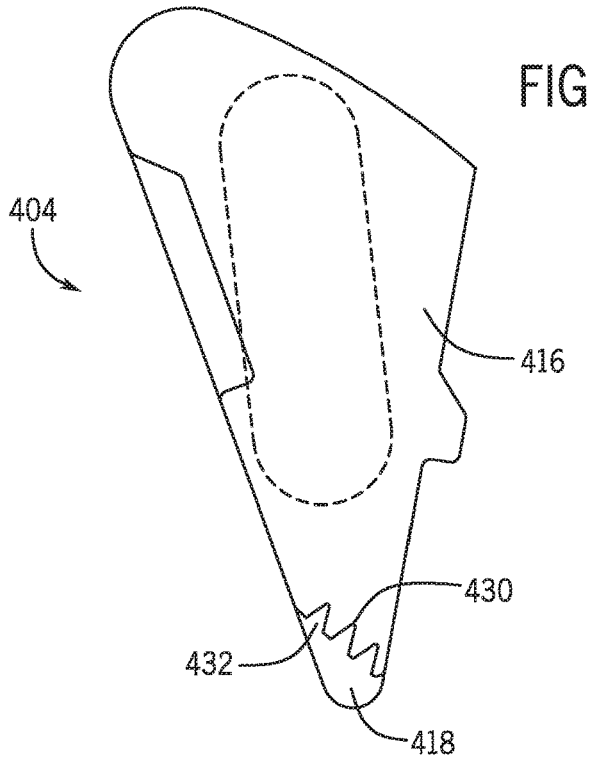
FIG. 8
FIG. 9
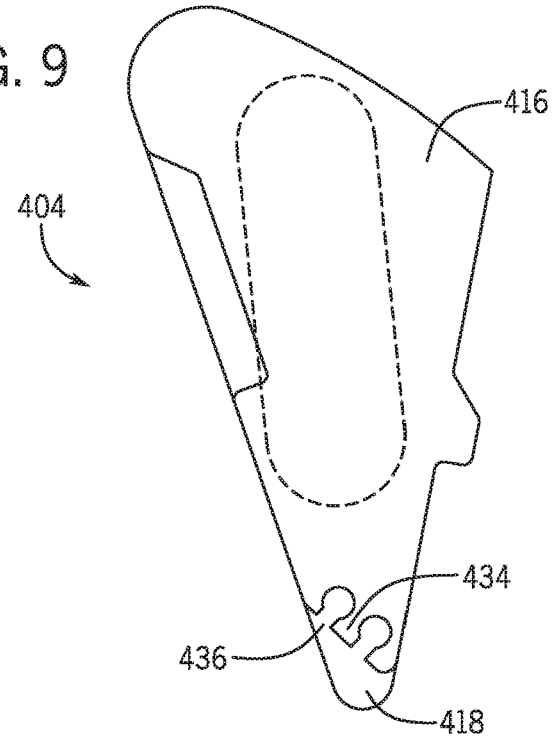

PACKER ASSEMBLY WITH MULTI-MATERIAL INSERTS FOR BLOWOUT PREVENTER

BACKGROUND

This section is intended to provide relevant context information to facilitate a better understanding of the various aspects of the described embodiments. Accordingly, it should be understood that these statements are to be read in this light and not as admissions of prior art.

Blowout preventers (BOPS) are used extensively throughout the oil and gas industry as large specialized valves or similar mechanical devices that seal and control oil and gas wells. The two categories of BOPs that are most prevalent are ram BOPs and annular BOPs. BOP stacks frequently utilize both types of BOPs, typically with at least one annular BOP stacked above several ram BOPs. The ram assemblies (i.e., rams) in ram BOPs allow for shearing drill pipe in the case of shear ram assemblies, sealing off around drill pipe in the case of pipe ram assemblies or variable bore ram assemblies, or sealing off the bore in the case of blind ram assemblies. Typically, a BOP stack may be secured to a wellhead and may provide a safe means for sealing the well in the event of a system failure.

A typical ram BOP includes a main body or housing with a vertical bore. Ram bonnet assemblies may be bolted to opposing sides of the main body. One or more elastomeric sealing elements or "packers" may then be used to form a seal within the main body and against the ram bonnet assemblies. There are several configurations, but essentially they are all directed to preventing a leakage bypass between the mating faces of the ram assembly and the main body. Each bonnet assembly includes a piston that is laterally movable within a ram cavity of the bonnet assembly by pressurized hydraulic fluid acting on one side of the piston. The opposite side of each piston has a connecting rod attached thereto that in turn has a ram assembly mounted thereon.

The ram assemblies are designed to move laterally toward the vertical bore of the BOP to shear or seal off on any object located therein. For a shear ram BOP, the shear ram assemblies are used to shear or cut any object located in the vertical bore of the blowout preventer. Pipe ram assemblies and variable bore ram assemblies utilize seals or packers that close in on and seal off on a tubular within the vertical bore of the BOP, such as a section of drill pipe used during drilling operations. Blind ram assemblies also utilize seals, in which the ram assemblies close in and across the bore of the BOP when no object is present to seal across the bore.

The annular BOP utilizes an annular or a hemispherical piece of rubber usually reinforced with inserts. Unlike a ram-type BOP, which closes with a horizontal motion, an annular BOP closes inward around the drill string in a smooth inward motion to seal on the pipe or the open hole. The geometry of this movement reduces internal stresses and friction between the BOP body and the sealing element, which translates into a longer field life with less maintenance. The annular design may also operate with a much lower operating pressure, reducing the number of hydraulic accumulators necessary, and thereby reducing cost and complexity of the BOP.

Packers used for either a ram-type or annular BOPs can be designed to seal around pipe of a specific size in the BOP bore when the BOP is closed. Other packers though may be configured to seal around a range of pipe sizes, and are referred to as variable bore packers. Both packers form a pressure tight seal during a kick until the well bore pressure can be controlled.

To form a proper seal with a variable bore BOP, the packer material must be of a low enough hardness or durometer to close against the pipe and provide enough pressure for a range of pipe diameters. However, a low durometer also tends to make the packer suffer from lack of support during the loading process. Increased durometer packers may be used but more force is needed to form a seal, sometimes resulting in an inadequate seal due to incomplete closure and/or low pressure. Additionally, the increased durometer packers may not be able to seal against as wide a range of pipe diameters. With both the ram-type and annular variable bore BOPs, the packer typically includes an annular or two semi-circular elastomeric sealing elements with an array of support inserts embedded in the elastomeric material. The inserts are molded within the elastomeric material in a pattern around the opening of the elastomeric material, forming unitary structure. The structure allows the plurality of packer inserts to move and seat against different diameter tubular members and also helps prevent extrusion of the elastomeric material between the packer inserts and the tubular member.

Even with inserts, however, some packers still have durability issues. Although inserts help prevent extrusion, the inserts still include gaps between the insert tips and the pipe when the packer is actuated. When subject to load, the packer elastomeric material may still extrude through these small gaps, causing the packer material to tear and break apart and thus lose ability to form an adequate seal.

SUMMARY

In one embodiment, a blowout preventer for sealing against an object. The blowout preventer includes a housing with a bore extending through the housing. The object is extendable through the bore. A packer assembly is movably positioned within the housing and forms a seal within the housing. The packer assembly includes a body with an elastomeric material. An insert is partially positioned within the body. The insert includes a harder material section and a softer material section with respect to the harder material section and that deforms against the object.

In another embodiment, a packer assembly that forms a seal within a blowout preventer. The packer assembly includes a body that includes an elastomeric material. An insert at least partially positioned within the body. The insert includes a harder material section, and a softer material section with respect to the harder material section.

DESCRIPTION OF THE DRAWINGS

For a detailed description of the embodiments of the invention, reference will now be made to the accompanying drawings in which:

FIG. 8 depicts top view of an insert, according to one or more embodiments;

FIG. 9 depicts top view of an insert, according to one or more embodiments;

DETAILED DESCRIPTION

Figure 1:
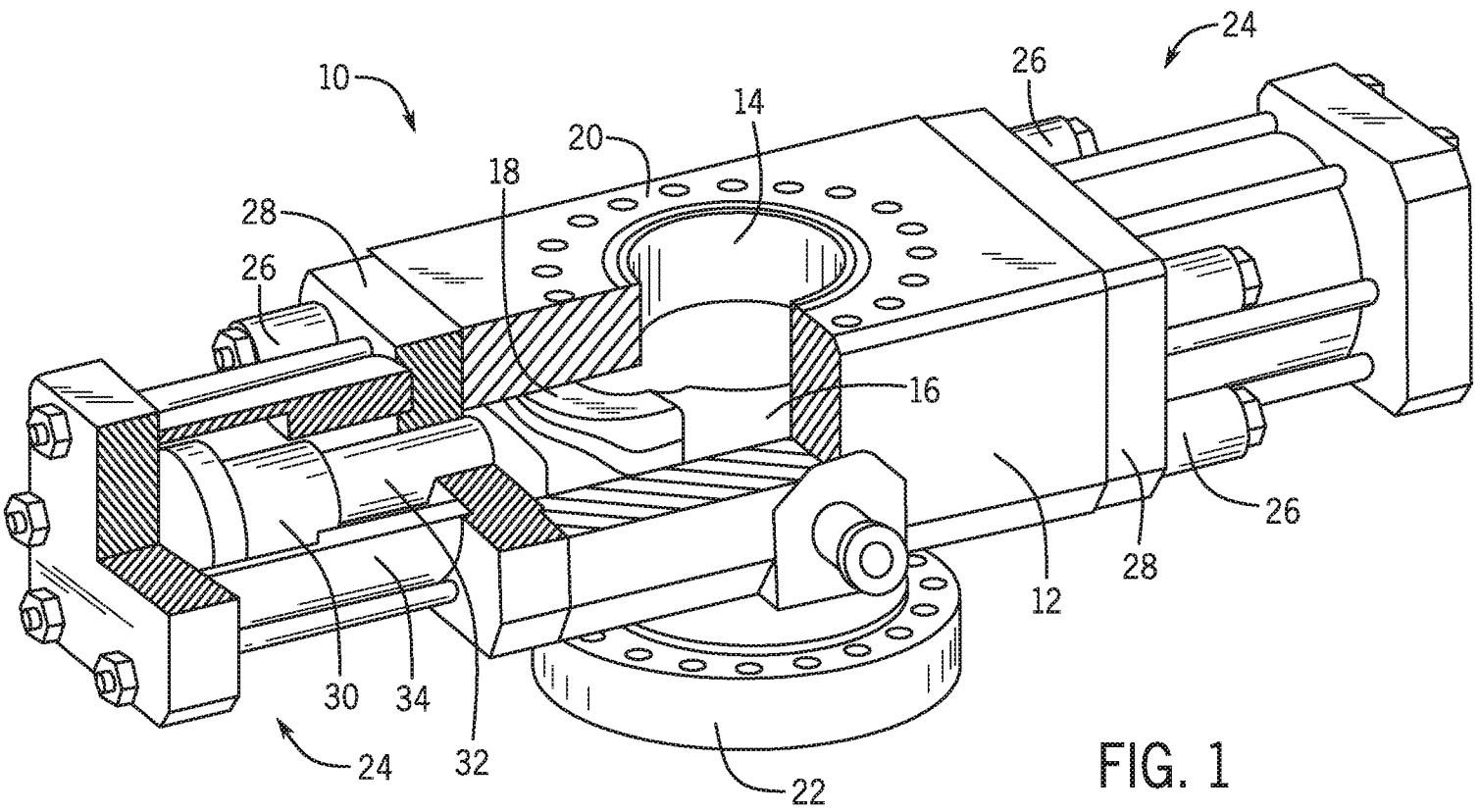
FIG. 1 depicts a sectional view of a ram blowout preventer, according to one or more embodiments.

The present disclosure may be used within a BOP, such as ram BOP and/or an annular BOP for either a surface or subsea well application. A sectional view of a ram BOP 10 in accordance with one or more embodiments is shown in FIG. 1. The BOP 10 includes a housing 12, such as a hollow body, with a (e.g., vertical) bore 14 that enables passage of fluid or an object (e.g., tubular member) through the BOP 10. The housing 12 further includes one or more cavities 16, such as cavities 16 opposed from each other with respect to the bore 14, with a ram assembly 18 movably positioned within each cavity 16. The BOP 10 may be coupled to other equipment that facilitates natural resource production. For instance, production equipment or other components may be attached to the top of the BOP 10 using a connection 20 (which may be facilitated in the form of fasteners), and the BOP 10 may be attached to a wellhead or spool using the flange 22 and additional fasteners.

One or more bonnet assemblies 24 are secured to the housing 12 and include various components that facilitate control of the ram assemblies 18 positioned in the BOP 10. The bonnet assemblies 24 are coupled to the housing 12 by using one or more fasteners 26 to secure the bonnets 28 of the bonnet assemblies 24 to the housing 12. The ram assemblies 18 are then actuated and moved through the cavities 16, into and out of the bore 14, by operating and moving a piston 30 and a rod 32 coupled thereto within a housing 34 of the bonnet assemblies 24. In operation, a force (e.g., from hydraulic pressure) may be applied to the pistons 30 to drive the rods 32, which in turn drives the ram assemblies 18 coupled thereto into the bore 14 of the BOP 10. The ram assemblies 18 cooperate with one another when driven together to seal the bore 14 and inhibit fluid flow through the BOP 10. For example, the ram assemblies 18 may be pipe ram assemblies, as shown, such that the pipe ram assemblies seal about a pipe or tubular member present within the bore 14 of the BOP housing 12.

Figure 2:
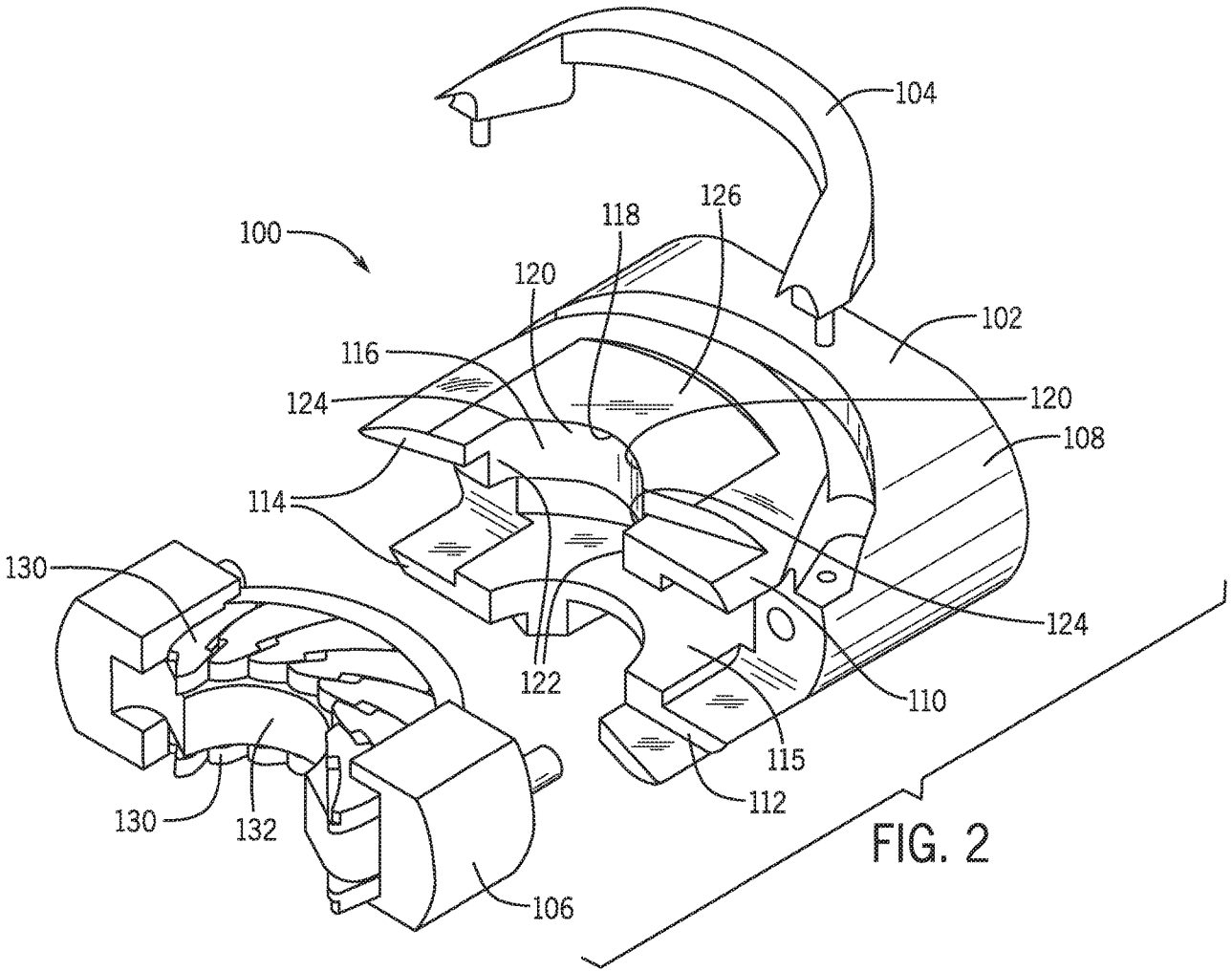
FIG. 2 depicts an exploded view of a variable bore ram packer assembly, according to one or more embodiments.

More particularly, in one or more embodiments, the ram assemblies 18 may be variable bore ram assemblies. For example, FIG. 2 shows an exploded view of a variable bore ram packer assembly 100 in accordance with one or more embodiments. The variable bore ram packer assembly 100 includes a ram body 102, a top seal 104, and a variable bore packer assembly 106. The variable bore packer assembly 106 may include one or more inserts 130 positioned within an elastomeric element or body 132, in which the inserts 130 provide support to the elastomeric body 132 during sealing engagement (e.g., against a tubular member). In particular, the inserts 130 may provide support to the elastomeric body 132 during sealing engagement when the variable bore packer assembly 106 is sealing against objects or tubular members of different sizes. Further, the top seal 104 may include an elastomeric element or body that may provide sealing engagement between the ram body 102 and the cavity 16 of the BOP housing 12.

The ram body 102 is a generally rectangular parallelepiped shape with rounded sides 108 that fit in the cavities 16 of the BOP housing 12. The ram body 102 includes an upper body 110 and a lower body 112 connected by a front face 114 and to define a ram packer cavity 115 therebetween. A ram bore profile 116 is formed within the front face 114, in which the ram bore profile 116 may be substantially U-shaped or semi-annular shaped and extend vertically through the upper body 110 to the ram packer cavity 115.

The ram bore profile 116 may further be characterized by a rear portion 118, diverging sides 120, and a front throat 122. The rear portion 118 is shown as an arcuate segment connected to the front throat 122 by the diverging sides 120. The front throat 122 intersects the front face 114 at a substantially perpendicular angle, and the arcuate sections 124 connect to the diverging sides 120. The area 126 adjacent the ram bore profile 116 may be hardened by suitable means as weld inlay or thermal treatment to increase the load carrying capacity of ram bore profile 116.

Figure 3:
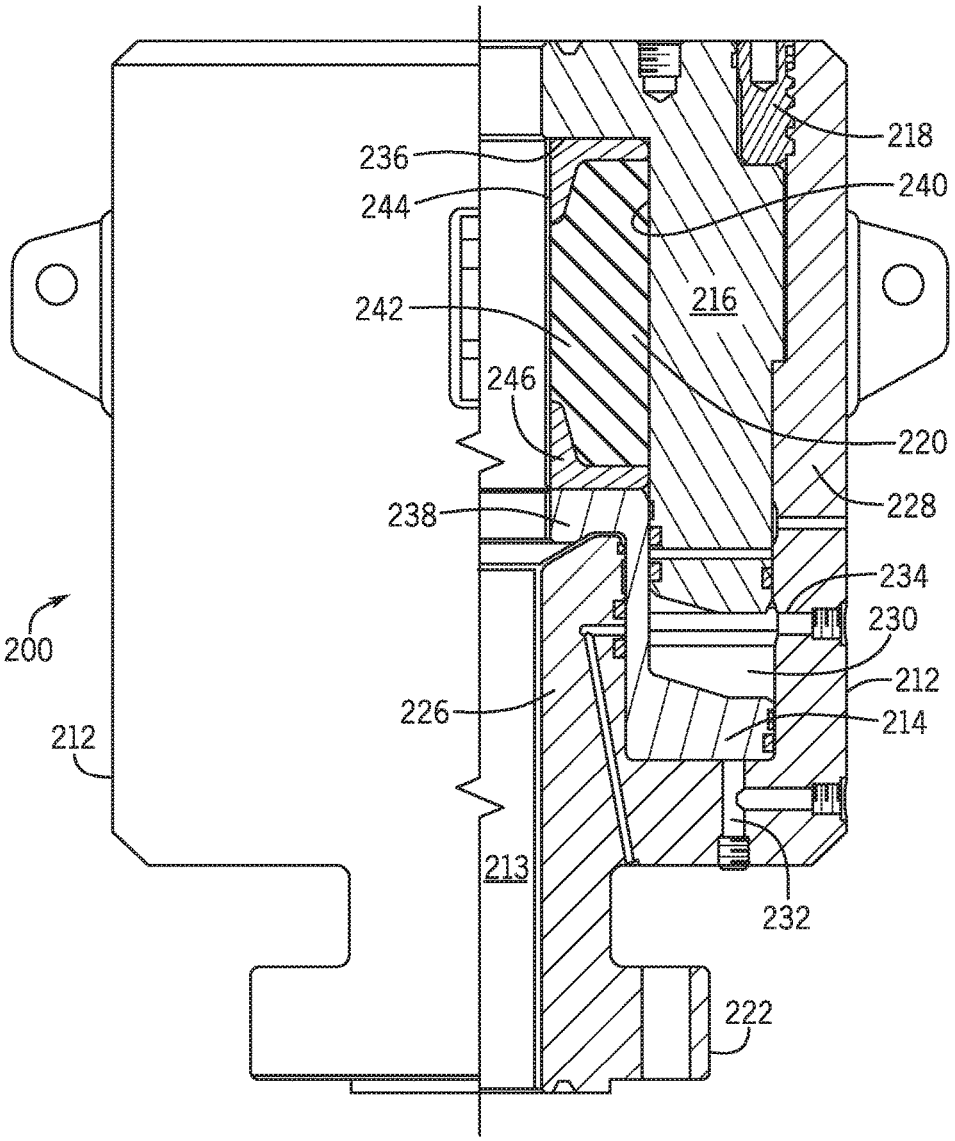
FIG. 3 depicts a sectional view of an annular blowout preventer in an open position, according to one or more embodiments.
Figure 4:
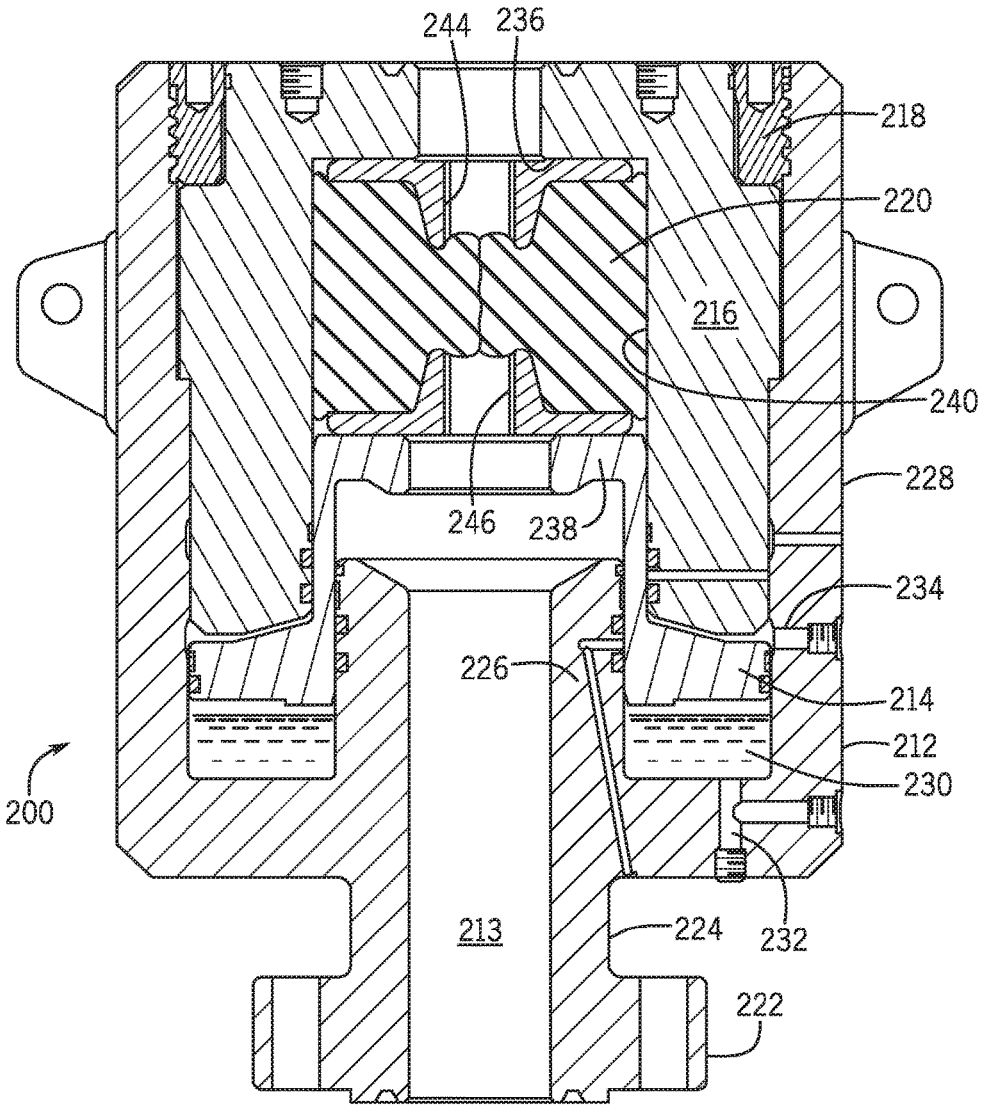
FIG. 4 depicts a sectional view of the annular blowout preventer in a closed position, according to one or more embodiments.

Referring now to FIGS. 3 and 4, multiple sectional views of an annular BOP 200 in accordance with one or more embodiments are shown. In particular, FIG. 3 shows the annular BOP 200 in an open position to enable fluid flow therethrough, and FIG. 4 shows the annular BOP 200 in a closed position to seal and prevent fluid flow therethrough.

The annular BOP 200 includes an annular housing 212 with a bore 213 therethrough, an annular piston 214, a retainer ring 216, a lock ring 218, and a packer 220. The housing 212 includes a lower flange 222 connected by a neck 224, an annular rim 226 extending upwardly from the neck 224, and an exterior annular housing section 228 that extends radially outward from the neck 24 and upwardly around and spaced from the rim 226. A chamber 230 is the annular space between the rim 226 and the section 228 below the lower end of the retainer ring 216. The piston 214 is movably positioned partially within the chamber 230, as shown. A passage 232 extends through the housing section 228 into the chamber 230 to deliver fluid under pressure to the lower side of the piston 214, causing the piston 214 to move upward, and then to exhaust fluids as the piston 214 moves downward. A passage 234 extends through the housing section 228 into the chamber 230 to deliver fluid under pressure to the upper side of the piston 214, causing the piston 214 to move downward, and to exhaust fluids as the piston 214 moves upward.

The packer 220 is annular in shape, as hereinafter described, and is positioned within the recess under a shoulder 236 of the retainer ring 216, and is engaged on its lower end by an annular arm 238 of the piston 214. Thus, as the piston 214 moves upward, the arm 38 exerts an axial force on the packer 220. The shoulder 236 prevents upward movement of the packer 220 and an inner surface 240 of the retainer ring 216 prevents radial outward movement of the packer 220 when the packer 220 is moved to the closed or sealed position. The packer 220, as shown, may include an annular body 242, an upper circular series of inserts 244 arranged on, bonded to, and/or embedded in the upper surface of the body 242, and a lower circular series of rigid inserts 246 arranged on, bonded to, and/or embedded in the lower surface of the body 242.

Accordingly, disclosed herein are a BOP apparatus and/or a packer assembly for a BOP apparatus. As shown above, the BOP may be a ram BOP, such as a variable bore ram BOP, or an annular BOP. The packer assembly is then used within the BOP to facilitate forming a seal within the BOP. For example, the packer assembly may be used to form a seal about an object positioned within the BOP, or may be used to form a seal about itself when no object is positioned within the BOP. The packer assembly includes an elastomeric body with one or more inserts positioned within the elastomeric body to provide support to the elastomeric body when forming the seal. The inserts may then include multiple materials, such as a harder material section and a softer material section, or more specifically a metallic section and a non-metallic section. The softer material section or the non-metallic section may be used to help prevent or diminish extrusion or deterioration of the elastomeric body, particularly when sealing.

Figure 5:
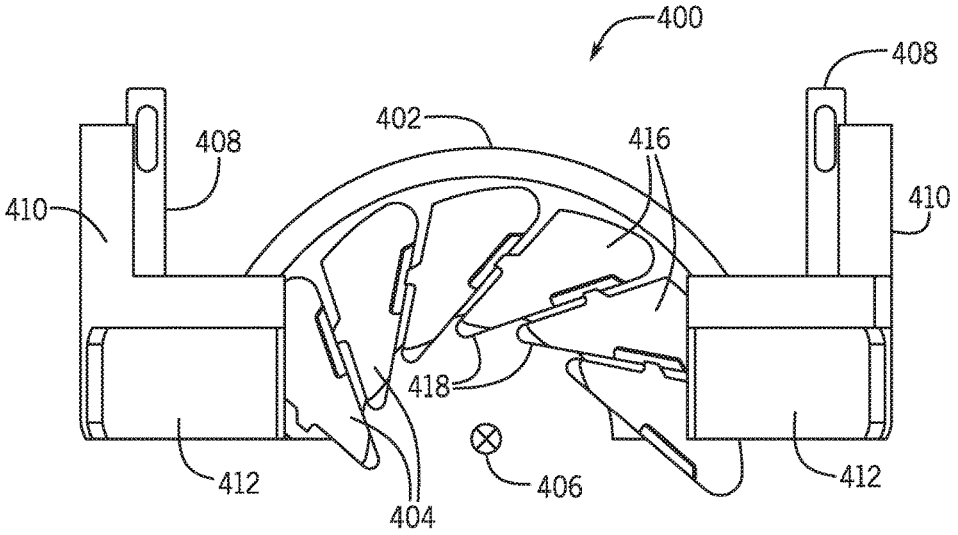
FIG. 5 depicts an above perspective view of a packer assembly including an elastomeric body and one or more inserts, according to one or more embodiments.
Figure 6:
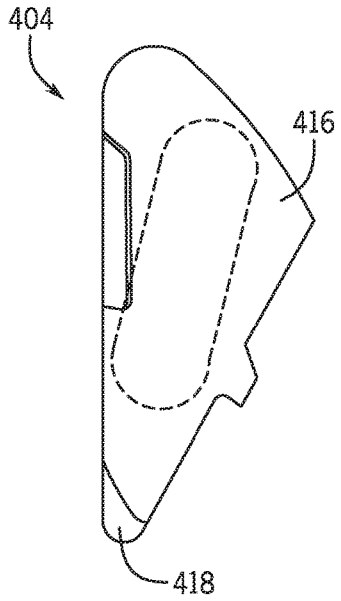
FIG. 6 depicts a top view of an insert, according to one or more embodiments.
Figure 7:
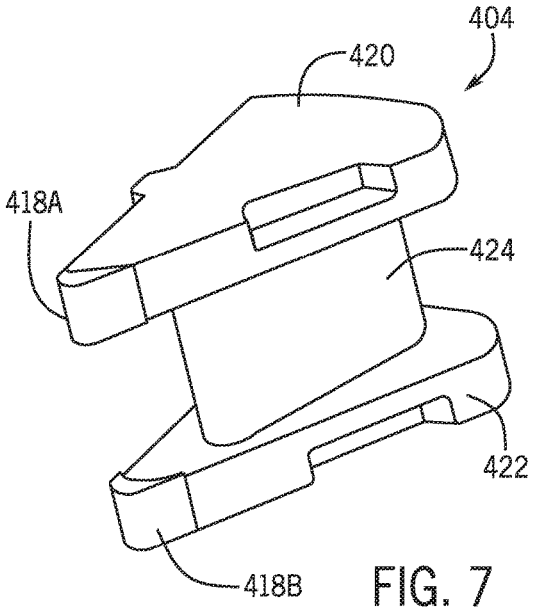
FIG. 7 depicts a side view of the insert, according to one or more embodiments.

Referring now to FIGS. 5-7, multiple perspective views of a packer assembly 400 and one or more inserts 404 in accordance with one or more embodiments of the present disclosure are shown. In particular, FIG. 5 shows an above perspective view of the packer assembly 400 including an elastomeric body 402 and one or more inserts 404, FIG. 6 shows an above perspective view of an insert 404, and FIG. 7 shows a side perspective view of the insert 404.

As shown, the packer assembly 400 includes the elastomeric body 402, in which the elastomeric body 402 may be formed from or include an elastomeric material (e.g., natural or synthetic rubber). The packer assembly 400 includes inserts 404 positioned within and molded into elastomeric body 402. The elastomeric body 402 includes a semi-annular shaped portion (or annular shape in other embodiments, such as for an annular BOP) formed about an axis 406 and is alignable with an axis of the bore of a BOP housing. The inserts 404 are positioned about the semi-annular shaped portion.

In this embodiment, the packer assembly 400 may include one or more packer pins 408 positioned or molded into the elastomeric body 402 for connecting the packer assembly 400 to a ram assembly. The elastomeric body 402 may be formed or molded to include side block seals 410 on the lateral edges. The elastomeric body 402 may be molded into a semi-elliptical shape with a front sealing face on an interior surface thereof (interior surface radially positioned about the axis 406 of the packer assembly 400), and then side sealing faces at each edge formed between side blocks 412 and adjacent the side block seals 410.

In an embodiment in which the packer assembly is used within an annular BOP, the packer assembly may not include the packer pins 408, side blocks 412, side block seals 410, front sealing faces, and/or the side sealing faces. Further, in such an embodiment, the packer assembly may have an annular shape with a bore extending through the packer assembly.

As mentioned above, the packer assembly 400 includes one or more inserts 404. Each insert 404 may include sections that include different materials, such as a section 416 that includes or is formed from a harder material (e.g., a metallic section) and a section 418 that includes or is formed from a softer material (e.g., a non-metallic section) with respect to each other. The section 418 may be formed or included as a tip or pointed end of the insert 404 such that the softer material section 418 is positioned radially closer to the axis 406 of the packer assembly 400 than the remainder or harder material section 416 of the insert 404. This may enable the softer material section 418 of the insert to diminish extrusion of the elastomeric body 402 when the packer assembly 400 forms a seal within the housing of a BOP. For example, when the packer assembly 400 forms a seal within a BOP, either against an object (e.g., a pipe or tubular member) or against itself, the softer material section 418 may deform (elastically or even plastically) to fill in gaps between adjacent inserts 404 to restrict the elastomeric body 402 from extruding through the gaps and damaging the elastomeric body 402.

The insert 404 includes a top support 420 (e.g., top plate), a bottom support 422 (e.g., bottom plate), and a central support 424 (e.g., central web). In this embodiment, the top support 420 and the bottom support 422 may be substantially triangular in shape with the central support 424 positioned therebetween. The central support 424 extends between the top support 420 and the bottom support 422 to connect the top support 420 and the bottom support 422. The central support 424 may be integrally formed with the top support 420 and the bottom support 422, such as by casting, or the central support 424 may be formed separate from the top support 420 and the bottom support 422 and then later coupled or attached, such as by welding. The central support 424 is shown having an elongated rectangular cross section, but differently shaped cross sections would be suitable provided they give sufficient bending strength to the insert 404. Accordingly, as the insert 404 may include the top support 420 and the bottom support 422, the top support 420 may include a top support softer material section 418A, and the bottom support may include a bottom support softer material section 418B.

In one or more embodiments, the material of the section 416 may have a higher elastic modulus, a lower deformation (e.g., elongation percentage or stretch ratio), and/or a higher hardness than that of the material of the section 418. In one embodiment, the section 416 may be formed from a material that includes metal (e.g., a metallic section), whereas the section 418 may be formed from a material that does not include metal (e.g., a non-metallic section). However, in other embodiments, the section 416 and the section 418 may both be formed from a metal, in which the section 416 will have a higher elastic modulus, a lower deformation (e.g., elongation percentage or stretch ratio), and/or a higher hardness than that of the non-metallic section 418.

Further, in one or more embodiments, the section 418 may have a higher elastic modulus, a lower deformation (e.g., elongation percentage or stretch ratio), and/or a higher hardness than that of the elastomeric material of the elastomeric body 402. For example, the section 418 may have an elastic modulus that is between about two to 100 times higher or more than that of the elastomeric material in the elastomeric body 402, and more particularly may be about 10 times higher or more than that of the elastomeric material (e.g., at between about 1% to 10% elongation). The section 418 may have a hardness that is at least five times or five units higher than that of the elastomeric material, such as when measuring a Shore hardness or durometer of the materials. The section 418 may have an elongation percentage that is at least 5% or above, and may have high temperature resistance, such as by having a glass transition temperature that is higher than the elastomeric material. Further, the section 416 may have an elastic modulus that is at least 5,000,000 psi (34.4 GPa) or above. A table providing examples of mechanical properties for the different materials of the inserts 404 and the elastomeric material of the elastomeric body 402 is provided below:

| | Elastic Modulus* (psi) | Elongation (%) | Hardness (Shore Hardness) |
|---|---|---|---|
| Elastomeric Material 1 for Packer Assembly | 5698 | 596 | 70 Shore A |
| Elastomeric Material 2 for Packer Assembly | 4523 | 612 | 80 Shore A |
| Material 1 for Section 418 | 65,475 | 23 | 92 Shore A |
| Material 2 for Section 418 | 47,703 | 64 | 88 Shore A |
| Plastic (PEEK) for Section 418 | 500,000 | 50 | 60 Shore D |
| Carbon Steel for Section 416 | 25,000,000 | / | / |

*Elastic modulus based on 1~10% elongation

Materials that may be used for section 418 may include a polymer including at least one of polyether ether ketone (PEEK), polyethylene terephthalate (PET), polymethyl methacrylate (PMMA), polyamide-imide, polybenzimidazole, acrylonitrile-methyl acrylate copolymer, cellulose acetate, polyvinyl fluoride, amorphous nylon, polybutylene terephathalate, polyethylene naphthalate, polyimide, polyacetal, acrylonitrile butadiene styrene copolymer (ABS), ethylene chlorotrifluoroethylene copolymer (ECTFE), polyvinylidene fluoride, polyether sulfone, polyetherimide, polycarbonate, polyphenylene sulfide, ethylene vinyl alcohol copolymer (EVOH), cycloolefin polymer, cycloolefin copolymer, aromatic fluorine-containing polyarylates ionomer, epoxy, phenolic resin, polyurethane, and/or combinations thereof. Further, other materials that may be used for section 418 may include a plastic material, a glass fiber reinforced material, a multilayer material comprising a polymer and an inorganic material, a nanoparticle material, a polymer composite material, an elastomeric material, a metal, and/or combinations thereof.

One or more different methods or configurations may be used when assembling or manufacturing an insert in accordance with the present disclosure. For example, the different sections of the insert may be connected to each other through an adhesive connection and/or a mechanical connection. In FIGS. 5-7, the section 416 and the section 418 are connected to each other through an adhesive connection, with adhesive suitable for high temperature and high pressure applications appropriately applied to the contacting surfaces between the sections 416 and 418. The surface area of the contacting surfaces between the different sections of the insert may be increased to facilitate an adhesive connection for the insert. For example, as shown in FIG. 8, the section 416 and the section 418 of the insert 404 may have complementary or corresponding contacting surfaces 430 and 432, respectively, such as a notched or serrated surface, to facilitate the adhesive connection between the sections 416 and 418. Additionally or alternatively, the sections 416 and 418 may female and male corresponding surfaces 434 and 436, respectively, such as shown in FIG. 9, to facilitate the mechanical connection between the sections 416 and 418. In other embodiments, one or both of the sections 416 and 418 may include holes or apertures formed therein, or fibers, springs, or other elements could extend between the sections 416 and 418, to increase or facilitate the connection between the sections 416 and 418 within the insert 404.

As mentioned above, a packer assembly in accordance with the present disclosure is movable between an open position to allow fluid flow through a bore of a BOP housing and a closed position to form the seal within the BOP housing and prevent fluid flow through the bore. The packer assembly may be used to form a seal about an object (if present) positioned within the bore of the BOP housing. Such an object may have different shapes, sizes, thicknesses, and other dimensions and properties, in which an object may include a drill pipe joint, a casing joint, a tool joint, or a wireline.

Figure 10:
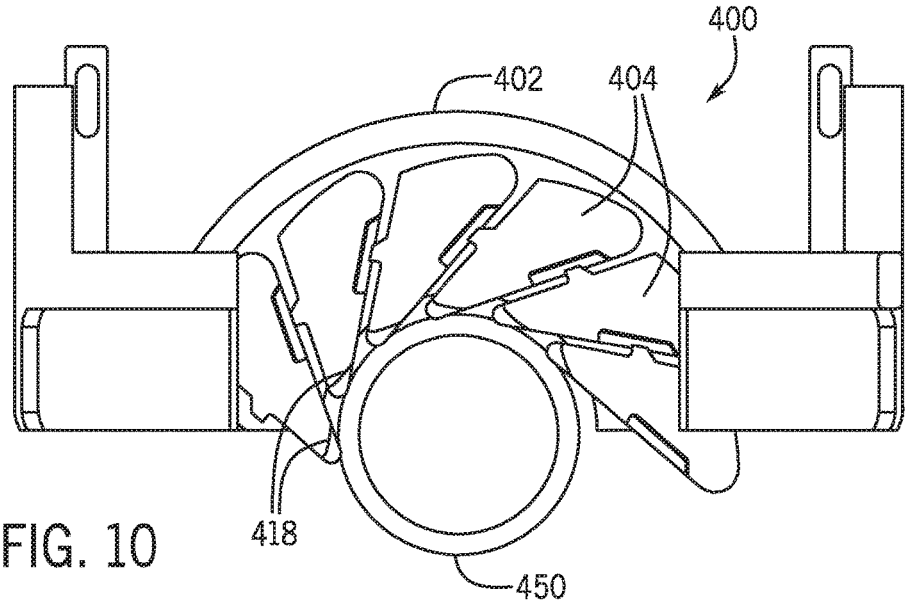
FIG. 10 depicts a top view of a packer assembly used to seal about a tubular member, according to one or more embodiments.
Figure 11:
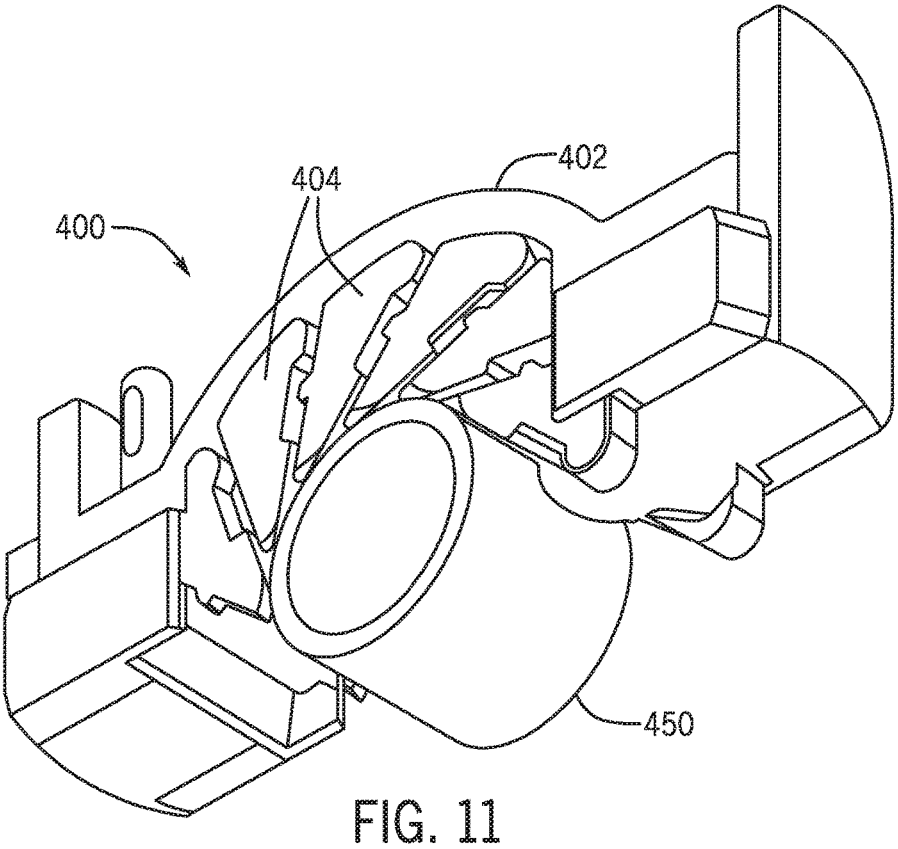
FIG. 11 depicts a perspective view of a packer assembly used to seal about a tubular member, according to one or more embodiments.

FIGS. 10 and 11 show different perspective views of the packer assembly 400 used to seal about a drill pipe 450. The inserts 404 of the packer assembly are used to slide and rotate about the drill pipe 450, such as similar to that of an "iris" shutter of a camera, to contain and limit the flow of the elastomeric material of the elastomeric body 402 around the drill pipe 450. During this movement, small gaps may exist between the drill pipe 450 and the inserts 404 of the packer assembly 400. Accordingly, in one or more embodiments, the section 418 of the inserts 404 may deform, such as elastically, to help eliminate or minimize these small gaps and contain and limit the flow of the elastomeric material of the elastomeric body 402 around the drill pipe 450. This may increase the useful life for the elastomeric body 402 of the packer assembly 400.

As shown and discussed above, a packer assembly in accordance with the present disclosure may be used within a ram BOP, such as by having a packer assembly positioned upon a ram assembly that is movable into and out of a bore of a BOP housing. In another embodiment, a packer assembly in accordance with the present disclosure may be included within an annular BOP. For example, the elastomeric body of the packer assembly may include an annular shape (as opposed to only a semi-annular shape) with the inserts and interior inserts positioned within the annular body.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A packer assembly that forms a seal against an object within a blowout preventer, the packer assembly comprising:

a body comprising an elastomeric material, wherein the elastomeric material is configured to contact and deform against the object to form the seal;

an insert at least partially embedded within the body, the insert comprising:

a harder material section; and a softer material section with respect to the harder material section and configured to deform against the object, wherein the softer material section is coupled to the harder material section.

2. The packer assembly of claim 1, wherein the harder material section comprises a metallic material and the softer material section comprises a non-metallic material.

3. The packer assembly of claim 1, wherein the softer material section comprises at least one of a plastic material, a glass fiber reinforced material, a multilayer material comprising a polymer and an inorganic material, a nanoparticle material, a polymer composite material, another elastomeric material, and a metal.

4. The packer assembly of claim 1, wherein the softer material section comprises a polymer comprising at least one of polyether ether ketone, polyethylene terephthalate, polyamide, polymethyl methacrylate, polyamide-imide, acrylonitrile-methyl acrylate copolymer, cellulose acetate, polyvinyl fluoride, amorphous nylon, polybutylene terephathalate, polyethylene naphthalate, polyimide, polyacetal, acrylonitrile butadiene styrene copolymer, ethylene chlorotrifluoroethylene copolymer, polyvinylidene fluoride, polyether sulfone, polyetherimide, polycarbonate, polyphenylene sulfide, polybenzimidazole, ethylene vinyl alcohol copolymer, cycloolefin polymer, cycloolefin copolymer, aromatic fluorine-containing polyarylates ionomer, phenolic resin, epoxy, and polyurethane.

5. The packer assembly of claim 1, wherein:

the softer material section comprises an elastic modulus that is between two to 100 times greater than that of the elastomeric material; and the softer material section comprises a hardness that is at least five units (shore A) greater than that of the elastomeric material.

6. The packer assembly of claim 1, comprising a plurality of inserts.

7. The packer assembly of claim 1, wherein the body comprises at least a semi-annular body formed about an axis.

8. The packer assembly of claim 7, wherein the softer material section comprises a tip that is positioned radially closer to the axis than the harder material section of the insert.

9. The packer assembly of claim 7, wherein:

the insert comprises a top support, a bottom support, and a central support extending between the top support and the bottom support;

the top support comprises a top support harder material section and a top support softer material section; and the bottom support comprises a bottom support harder material section and a bottom support softer material section.

10. A blowout preventer for sealing against an object, comprising:

a housing defining a bore extending through the housing, wherein the housing is configured to receive the object within the bore; and a packer assembly movably positioned within the housing and configured to form a seal with the object, the packer assembly comprising:

a body comprising an elastomeric material configured to contact and deform against the object; and an insert at least partially embedded within the body, the insert comprising:

a harder material section; and a softer material section with respect to the harder material section and configured to deform against the object, wherein the softer material section is coupled to the harder material section.

11. The blowout preventer of claim 10, wherein the harder material section comprises a metallic material and the softer material section comprises a non-metallic material.

12. The blowout preventer of claim 10, wherein the softer material section comprises a tip that is positioned radially closer to an axis of the packer assembly than the harder material section.

13. The blowout preventer of claim 10, comprising a plurality of inserts.

14. The blowout preventer of claim 10, wherein:

the insert comprises a top support, a bottom support, and a central support extending between the top support and the bottom support;

the top support comprises a top support harder material section and a top support softer material section; and the bottom support comprises a bottom support harder material section and a bottom support softer material section.

15. The blowout preventer of claim 10, wherein:

the softer material section comprises an elastic modulus that is between two to 100 times greater than that of the elastomeric material; and the softer material section comprises a hardness that is at least five units (shore A) greater than that of the elastomeric material.

16. The blowout preventer of claim 10, wherein the harder material section and the softer material section are connected to each other through an adhesive connection and/or a mechanical connection.

17. The blowout preventer of claim 10, wherein the softer material section comprises at least one of a plastic material, a glass fiber reinforced material, a multilayer material comprising a polymer and an inorganic material, a nanoparticle material, a polymer composite material, and another elastomeric material.

18. The blowout preventer of claim 10, wherein the softer material section comprises a polymer comprising at least one of polyether ether ketone, polyethylene terephthalate, polyamide, polymethyl methacrylate, polyamide-imide, acrylonitrile-methyl acrylate copolymer, cellulose acetate, polyvinyl fluoride, amorphous nylon, polybutylene terephathalate, polyethylene naphthalate, polyimide, polyacetal, acrylonitrile butadiene styrene copolymer, ethylene chlorotrifluoroethylene copolymer, polyvinylidene fluoride, polyether sulfone, polyetherimide, polycarbonate and high heat polycarbonate, polybenzimidazole, polyphenylene sulfide, ethylene vinyl alcohol copolymer, cycloolefin polymer, cycloolefin copolymer, aromatic fluorine-containing polyarylates ionomer, phenolic resin, epoxy, and polyurethane.

19. The blowout preventer of claim 10, wherein the packer assembly is movable between an open position to allow fluid flow through the bore and a closed position that prevents fluid flow through the bore.

20. The blowout preventer of claim 10, wherein:

the housing defines a cavity that intersects the bore;

the blowout preventer further comprises a ram assembly movably positionable within the cavity and at least partially movable into the bore of the housing; and the packer assembly is coupled to the ram assembly and is movable with the ram assembly to form the seal at least partially about the object.

21. The blowout preventer BOP of claim 10, wherein:

the housing comprises an annular blowout preventer housing; and the body comprises an annular body positioned about the bore of the annular blowout preventer housing.

* * * * *